US005680012A

United States Patent [19]

Walker et al.

[11] Patent Number: 5,680,012

[45] Date of Patent: *Oct. 21, 1997

[54] MAGNETRON WITH TAPERED ANODE VANE TIPS

[75] Inventors: Christopher Martin Walker, Montoursville, Pa.; Geoffrey Thornber, Aptos, Calif.

[73] Assignee: Litton Systems, Inc., Woodland Hills, Calif.

[ * ] Notice: The term of this patent shall not extend beyond the expiration date of Pat. No. 5,483,123.

[21] Appl. No.: 241,637

[22] Filed: May 12, 1994

Related U.S. Application Data

[63] Continuation-in-part of Ser. No. 55,823, Apr. 30, 1993, Pat. No. 5,483,123.

[51] Int. Cl.[6] ..... H01J 23/18; H01J 23/22

[52] U.S. Cl. ..... 315/39.73; 315/39.75; 315/39.69

[58] Field of Search ..... 315/39.75, 39.73, 315/39.69, 39.51

[56] References Cited

U.S. PATENT DOCUMENTS

| | | | |
|---|---|---|---|
| 2,610,309 | 9/1952 | Gutton | 315/39.75 X |
| 2,860,285 | 11/1958 | Smith | 315/39.69 X |
| 2,866,920 | 12/1958 | Haagensen | 315/39.63 |
| 2,953,715 | 9/1960 | Kumpfer | 315/39.75 |
| 2,992,362 | 7/1961 | Boyd | 315/39.75 |
| 3,305,693 | 2/1967 | Hull | 315/39.69 |
| 4,056,756 | 11/1977 | Derby | 315/39.69 |
| 4,644,225 | 2/1987 | Arga et al. | 315/39.69 X |
| 4,720,659 | 1/1988 | Aiga et al. | 315/39.69 |
| 5,045,814 | 9/1991 | English et al. | 331/86 |
| 5,483,123 | 1/1996 | Walken et al. | 315/39.73 |

FOREIGN PATENT DOCUMENTS

| | | | |
|---|---|---|---|
| 519803 | 12/1992 | European Pat. Off. | 315/39.69 |
| 55372 | 5/1977 | Japan | 315/39.75 |
| 91934 | 4/1988 | Japan | 315/39.75 |
| 2-230637 | 9/1990 | Japan . | |
| 5021014 | 1/1993 | Japan | 315/39.51 |
| 5054806 | 3/1993 | Japan | 315/39.69 |
| 1088087 | 4/1984 | U.S.S.R. | 315/39.75 |
| 755526 | 8/1956 | United Kingdom . | |
| 848920 | 9/1960 | United Kingdom . | |
| 2 087 143 | 5/1982 | United Kingdom . | |
| 2237140 | 4/1991 | United Kingdom | 315/39.65 |

OTHER PUBLICATIONS

"A Study Of Locking Phenomena In Oscillators" by Robert Adler, Proceedings of the IEEE, vol. 61, No. 10, Oct. 1973, pp. 1380–1385.

"Synchronization Of Oscillators" by Robert D. Huntoon and A. Weiss, Proceedings of the I.R.E., Dec. 1947, pp. 1415–1423.

"RF Phase Control In Pulsed Magnetrons" by E.D. David, Jr., Proceedings of the I.R.E., Jun. 1952, pp. 669–685.

*Primary Examiner*—Benny T. Lee
*Attorney, Agent, or Firm*—Graham & James LLP

[57] ABSTRACT

An anode structure of the present invention provides radially disposed first vanes and radially disposed second vanes interdigitating with the first vanes. The first vanes and the second vanes are each interconnected by a first strap and a second strap, respectively. The first strap and the second strap are disposed coaxially on the same side of the vane structure and are generally rectangular in cross-section, having substantially parallel facing surfaces. Each of the vanes is generally T-shaped, with a relatively wide first portion and a relatively narrow second portion. The first portion is disposed proximate to an axis of the cavity with the second portion extending radially outward therefrom. The first portion has a radially tapered region extending to an innermost edge of the vanes, disposed completely within a diameter defined by an innermost one of said vanes.

7 Claims, 3 Drawing Sheets

FIG. 1
PRIOR ART
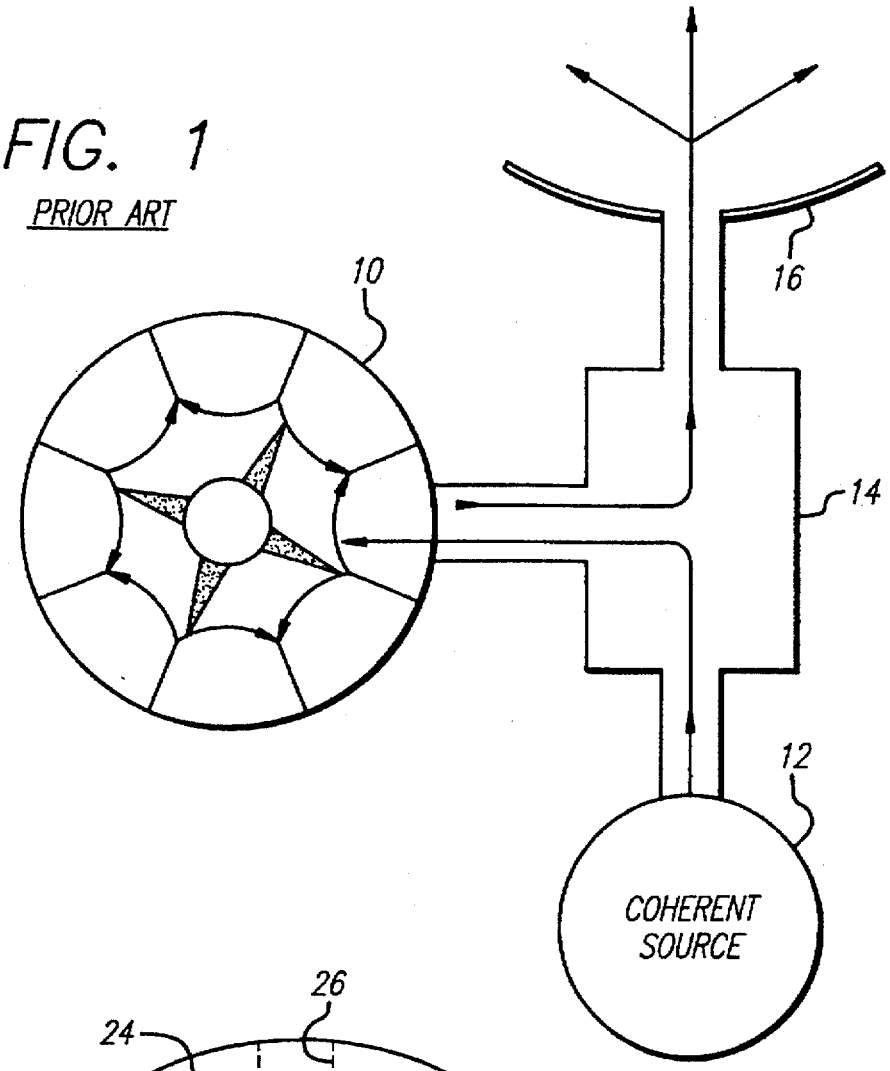
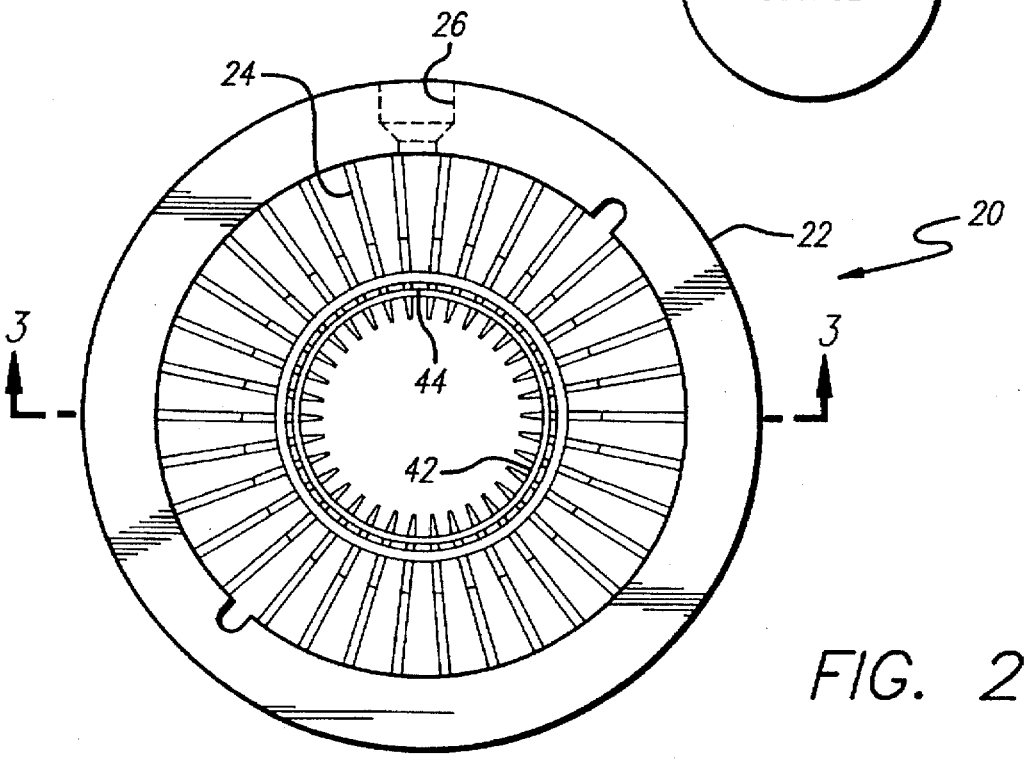
FIG. 2

FIG. 3
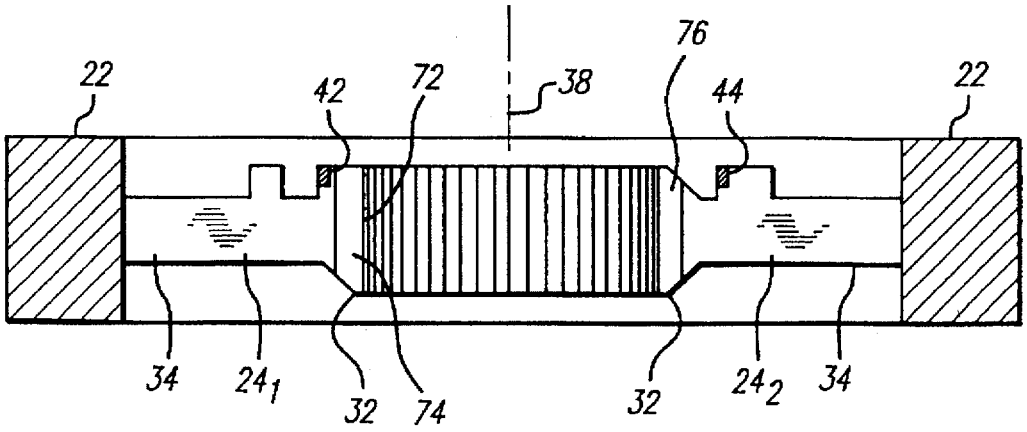
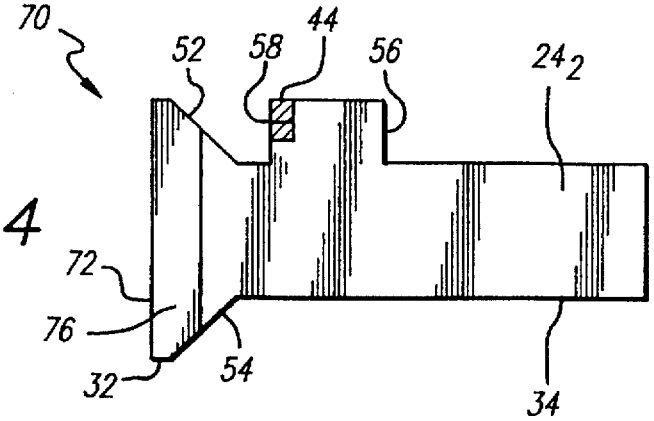
FIG. 4
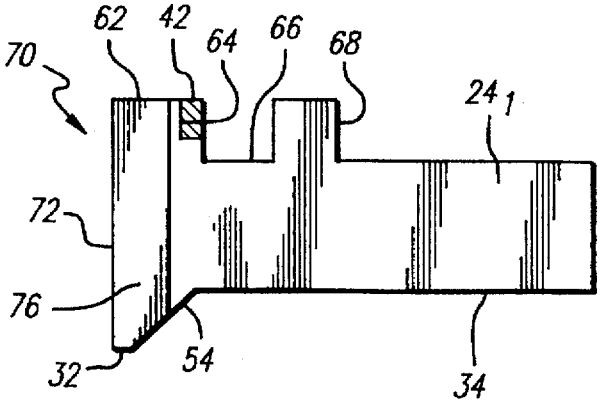
FIG. 5
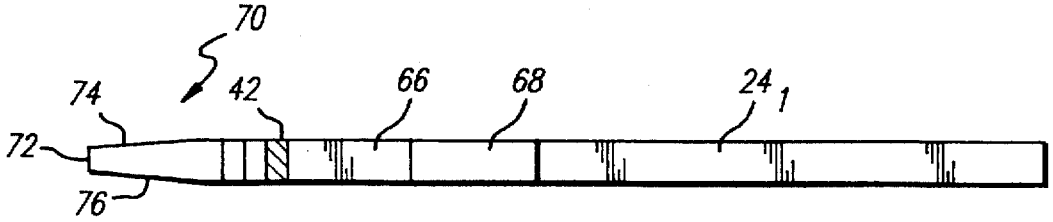
FIG. 6

MAGNETRON WITH TAPERED ANODE VANE TIPS

Related Application

This is a continuation-in-part of copending application Ser. No. 08/055,823, filed Apr. 30, 1993, now U.S. Pat. No. 5,483,123, issued Jan. 9, 1996.

BACKGROUND OF THE INVENTION

1. Field of the Invention

The present invention relates to magnetrons and, more particularly, to an anode structure utilizing a novel vane configuration for increased efficiency, thermal capacity and operational life.

2. Description of Related Art

Magnetrons have been used for several years in electronic systems that require high RF power, such as radar systems. A magnetron typically includes a central cylindrically shaped cathode coaxially surrounded by an annular anode structure having an interaction region provided between the cathode surface and the anode. The anode structure may include a network of vanes which provides a resonant cavity tuned to provide a mode of oscillation for the magnetron.

Upon application of an electric field between the cathode and the anode, the cathode surface emits a space-charge cloud of electrons. A magnetic field is provided along the cathode axis, perpendicular to the electric fields, which causes the emitted electrons to spiral into cycloidal paths in orbit around the cathode. When RF fields are present on the vane structure, the rotating space-charge cloud is concentrated into a spoke-like pattern, due to the acceleration and retardation of electrons in regions away from the spokes. The electron bunching induces high RF voltages on the anode circuit, and the RF levels on the anode build up until the magnetron is drawing full peak current for any given operating voltage. Electron current flows through the spokes from the cathode to the anode, producing a high power RF output signal at the desired mode of oscillation.

One particular type of magnetron, known as an injection locked magnetron, utilizes an external oscillator to inject a sinusoidal signal into the anode structure of the magnetron at a frequency close to its natural resonant frequency. These injection locked magnetrons can then be caused to operate in the $\pi$ mode of oscillation at a precise frequency determined by the external oscillator. The advent of higher power solid state oscillators has increased the feasibility of injection locked magnetrons. Injection locked magnetrons are further described in U.S. Pat. No. 5,045,814, by English et al., which is assigned to the common assignee.

It has long been desirable in magnetrons to increase the frequency stability of the magnetrons. Frequency stability is found to be dependent in part upon the thickness of the vanes. Thinner vanes expand more than thicker vanes for a given thermal loading, and therefore result in lower frequency stability for the magnetron. This effect is more severe at the high duty cycle operation associated with high repetition rates in the injection locked mode, as the change in magnetron frequency reduces the effective bandwidth of the system.

The incorporation of as thick an anode vane as possible is obviously desirable for the above reasons, but has two other disadvantages. The thicker vane results in lower electronic efficiency, and is also more susceptible to causing frequency change from cathode evaporation deposits. This latter effect arises from the fact that a thermionic emitter operates at a temperature high enough to cause its material to evaporate and some of this material is deposited on the vane tips facing the cathode. This material increases the thickness of the vanes, and in so doing, decreases the clearance between adjacent vanes. The gradual increase in vane thickness tends to increase the capacitance of the vanes with time, degrading the operational life of the magnetron. Thin vanes are less susceptible to cathode material deposition, since they already have greater clearance between adjacent vanes.

Accordingly, a need exists to provide an anode structure for a magnetron having increased efficiency, increased thermal stability and increased operational life. Ideally, the anode structure would combine the benefits of thick and thin vanes without the associated drawbacks.

SUMMARY OF THE INVENTION

In addressing these needs and deficiencies of the prior art, a tapered vane anode structure for an injection locked magnetron is provided.

The anode structure of the present invention comprises radially disposed first vanes and radially disposed second vanes interdigitating between the first vanes. The first vanes and the second vanes are each interconnected by a first strap and a second strap, respectively. The first strap and the second strap are disposed coaxially on the same side of the vane structure and are generally rectangular in cross-section. The vanes have a thickness which tapers at the tips from a uniform thickness to a substantially reduced thickness. The tapered portion may occur inside the diameter of the inner strap.

More particularly, each of the vanes is generally T-shaped. Each vane has a relatively wide first portion disposed proximate to an axis of the cavity and a relatively narrow second portion extending radially outward therefrom. The first portion is relatively short with respect to the overall length of the vane.

A more complete understanding of the tapered vane anode circuit for an injection locked magnetron will be afforded to those skilled in the art, as well as a realization of additional advantages and objects thereof, by a consideration of the following detailed description of the preferred embodiment. Reference will be made to the appended sheets of drawings which will first be described briefly.

BRIEF DESCRIPTION OF THE DRAWINGS

FIG. 1 is a schematic diagram of a typical magnetron oscillator circuit used in the prior art;

FIG. 2 is a top view of an anode circuit constructed in accordance with the principles of the present invention;

FIG. 3 is a side view taken along line 3—3 of FIG. 2;

FIG. 4 is a side view of a first anode vane;

FIG. 5 is a side view of a second anode vane;

FIG. 6 is an end view of a single anode vane; and

DETAILED DESCRIPTION OF THE PREFERRED EMBODIMENT

Figure 7A:
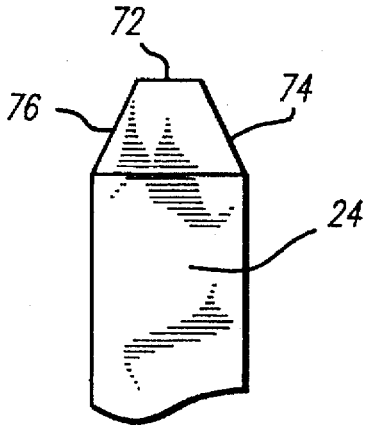
FIG. 7A is an enlarged partial end view of the tapered vane tips of the present invention.

The present invention provides an anode structure for a magnetron having increased efficiency, increased thermal stability and increased operational life.

Referring first to FIG. 1, there is shown a schematic diagram illustrating the use of an injection locked magnetron 10. A source 12 of coherent microwave energy delivers a low power sinusoidal signal to a circulator 14. The source 12 may include a solid state dielectric resonant oscillator. The circulator injects the low power signal into the magnetron 10. The low power signal is amplified by the magnetron 10 as is well-known in the art. The amplified energy developed by the magnetron 10 is then redirected to the circulator 14. The high power microwave energy is then coupled to an antenna 16 to radiate the high power coherent output energy.

Referring next to FIG. 2, an anode circuit 20 for the magnetron 10 is illustrated. The circuit 20 includes an anode ring 22 and a plurality of radial anode vanes 24 which extend inwardly from the anode ring. A port 26 extends radially through a portion of the anode ring 22, and provides a path for the injected low power signal and the amplified output signal.

The radial anode vanes 24 include a plurality of first radial vanes $24_1$ and a plurality of second radial vanes $24_2$, illustrated in FIGS. 3–5. The first radial vanes $24_1$ are interdigital with the second radial vanes $24_2$. Each of the first vanes $24_1$ and second vanes $24_2$ has a relatively wide first portion 32 and a relatively narrow second portion 34. The first portion 32 is radially proximate to an axis 38 (see FIG. 3) of the anode circuit 20 (see FIG. 2) about which the magnetron cathode is disposed, and is relatively short with respect to the overall length of the vane $24_1$ or $24_2$. The combination of the wide first portion 32 with the narrow second portion 34 produces generally T-shaped anode vanes $24_1$ and $24_2$ which provides unique characteristics over conventional vanes having uniform width. By keeping the first portion 32 relatively short, the vanes 24 have a relatively low total capacitance. The narrow second portion 34 concentrates magnetic field lines around vanes $24_1$ and $24_2$ to create a high inductance region. The low vane capacitance coupled with the high inductance yields a relatively high circuit impedance.

The anode circuit 20 further includes a first strap 42 (see FIGS. 3, 5) and a second strap 44 (see FIGS. 3, 4). Each of the first strap 42 and the second strap 44 are coaxial with the axis 38, and are both illustrated as being disposed along a single edge of the first and second vanes $24_1$ and $24_2$. Alternatively, the straps 42, 44 may be disposed on opposite edges of the vanes $24_1$, $24_2$. The first strap 42 interconnects the first vanes $24_1$ and the second strap 44 interconnects the second vanes $24_2$. The straps 42 and 44 each have a generally rectangular cross-section, although alternative shapes are also anticipated.

The first anode vanes $24_1$ have a generally wide first portion 32 and a narrow second portion 34, as shown in FIG. 5. A tapered portion 54 at a lower edge of the vane $24_1$ reduces the width of the vane from the width of the first portion 32 to the width of the second portion 34. Opposite to the lower tapered portion 54, a tab portion 62 extends axially to a dimension equivalent to that of the first portion 32. A first channel 64 is disposed in the tab portion 62, providing an attachment point for the first strap 42. A space 66 (see also FIG. 6) is provided adjacent the tab portion 62 to permit passage of the second strap 44 (not shown in FIG. 5). A second tab portion 68 (see also FIG. 6) extends upwardly relative to the second narrow portion 34, and lies on an arc encompassing the tab portion 56 of the second anode vane $24_2$(see FIG. 4), described below. The first strap 42 may be secured into the channel 64 by conventional techniques, such as brazing, and the end of the second portion 34 may be secured in like manner to the anode ring 22 (see FIG. 3).

The second anode vanes $24_2$ also have a generally wide first portion 32 and a narrow second portion 34, as shown in FIG. 4. A tapered portion 52 at an upper edge of the vane $24_2$ and a tapered portion 54 at a lower edge of the vane reduce the width of the vane from the width of the first portion 32 to the width of the second portion 34. The upper tapered portion 52 provides access for passage of the first strap 42 (not shown in FIG. 4). A tab portion 56 extends from the narrow second portion 34 to an axial dimension equivalent to that of the first portion 32. A first channel 58 is disposed in the tab portion 56, providing an attachment point for the second strap 44. The strap 44 may be secured to the channel 58 by conventional techniques, such as brazing, and the end of the second portion 34 may also be brazed to the anode ring 22 (see FIG. 3).

The use of straps is known to generally improve mode separation in a magnetron. In the desired $\pi$ mode of operation, alternate anode vanes $24_1$ and $24_2$ are at the same RF potential. The electric field between the vanes reverses direction between each of the first vanes $24_1$ and the second vanes $24_2$. By connecting the alternate anode vanes $24_1$ and $24_2$ together by straps 42 and 44, no additional inductance will be introduced since the ends of the straps are at the same potential. Typically, the straps add capacitance to the anode circuit 20, so the $\pi$ mode frequency will be altered. In modes other than the $\pi$ mode, the voltage differences between alternate anode vanes $24_1$ and $24_2$ is not zero, so the straps introduce inductance as well as capacitance, resulting in different frequency shifts than occur for the $\pi$ mode. Thus, the undesired modes are shifted to frequencies far enough removed from the $\pi$ mode that the magnetron can be prevented from operating in these modes.

At the innermost radial end of the vanes $24_1$ and $24_2$, a radially tapered tip 70 is provided (see FIGS. 4–6). The tapered tip 70 extends from a lower edge of the vanes to an upper edge of the vanes, within the wide first portion 32 of the vanes. As illustrated in FIG. 6, the tapered tip 70 of the vane $24_1$ comprises a tapered surface 74 (see also FIG. 3) on a first side of the vanes, and a tapered surface 76 (see also FIGS. 3–5) on a second side of the vanes. The tapered surfaces 74, 76 are generally flat, and decrease the thickness of the vanes from a uniform thickness applied throughout the narrow portion of the vanes to a substantially reduced thickness at the end of the vane. The tapered tip 70 (see also FIG. 5) is illustrated as being fully contained within a diameter defined by the strap 42, which is the innermost one of the straps, though the tapered tip may extend beyond the strap. In the embodiment of FIG. 6, the tapered surfaces 74, 76 intersect with a blunted surface 72 (see also FIGS. 3–5), comprising an innermost edge of the vanes.

Figure 7B:
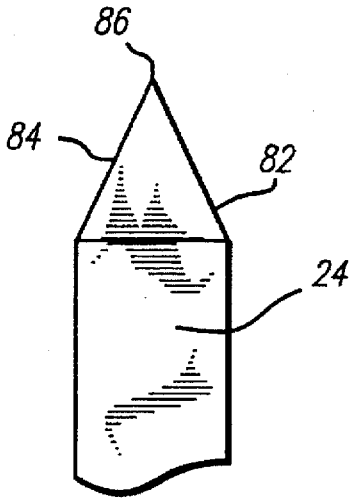
FIG. 7B is an enlarged partial end view of an alternative embodiment of the tapered vane tips of the present invention.
Figure 7C:
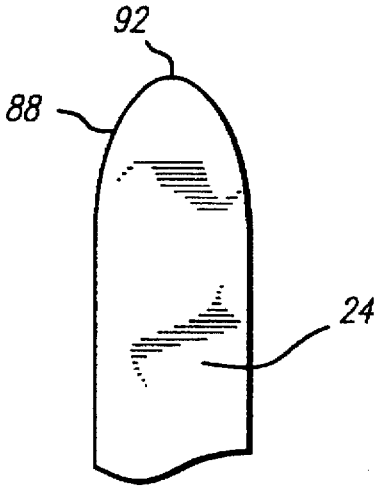
FIG. 7C is an enlarged partial end view of another alternative embodiment of the tapered vane tips of the present invention.
Figure 7D:
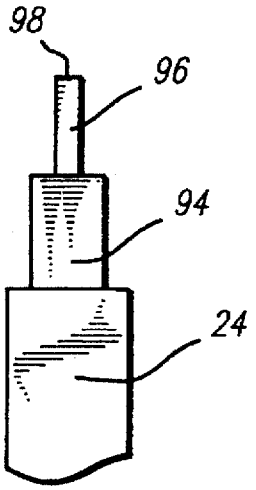
FIG. 7D is an enlarged partial end view of another alternative embodiment of the tapered vane tips of the present invention.

Alternative shapes for the tapered tip 72 are also contemplated, as illustrated in FIGS. 7A–7D. FIG. 7A illustrates a vane 24 that is similar to that of FIG. 6, having a blunted tip 72 and tapered surfaces 74, 76. FIG. 7B illustrates a vane 24 having a knife edge shape which comes to a sharp edge 86 with tapered surfaces 82, 84. FIG. 7C illustrates a vane 24 having a rounded surface 88 and tip 92. FIG. 7D illustrates a vane 24 having a compound taper comprising a plurality of steps 94, 96 that incrementally reduce the thickness from the uniform thickness to the narrowest thickness at a tip 98.

By decreasing the thickness of the vanes at the tip region, the clearance between adjacent vane tips is increased, making the vanes more tolerant of deposited material sputtered from the cathode surface. The thinner vanes at the tip region increase the RF field interaction, yielding an increase in electronic efficiency, providing an overall increase in magnetron efficiency. At the same time, the thermal handling benefits of a thick vane are preserved by having the uniform vane thickness at the narrow portion of the vanes.

Each of the vanes $24_1$, $24_2$, the first strap 42, and second strap 44 are dimensioned so that the circuit 20 has a single cavity impedance commensurate with a predetermined interaction impedance for the magnetron which is sufficient to sustain magnetron oscillation for a preselected injection locking bandwidth. The use of the high impedance T-shaped anode vanes 24 enable a greater number of vanes to be utilized without reducing the overall mode stability.

Having thus described a preferred embodiment of a high impedance anode circuit for an injection locked magnetron, it should be apparent to those skilled in the art that certain advantages of the within system have been achieved. It should also be appreciated that various modifications, adaptations, and alternative embodiments thereof may be made within the scope and spirit of the present invention. For example, an injection locked magnetron has been illustrated, but it should be apparent that the inventive concepts described above would be equally applicable to other magnetron types. The invention is further defined by the following claims.

What is claimed is:

1. An anode circuit for a magnetron, comprising:

an anode ring;

a plurality of first radial vanes extending from said anode ring, each of said plurality of first radial vanes having an upper edge and a lower edge, respectively;

a plurality of second radial vanes interdigitating with said first vanes and extending from said anode ring, each of said plurality of second radial vanes having an upper edge and a lower edge, respectively;

a first strap coaxially disposed along one of said upper edge and said lower edge of each one of said plurality of first vanes and interconnecting said plurality of first vanes;

a second strap coaxially disposed along one of said upper edge and said lower edge of each one of said plurality of second vanes which is the same edge as said plurality of first vanes such that said second strap is disposed within a circumference of said first strap, said second strap interconnecting each one of said plurality of second vanes; and each of said plurality of first and second vanes respectively having a uniform thickness over a substantial portion thereof with a radially tapered region at a tip portion of each of said plurality of first and second vanes, each said tapered region respectively extending from said corresponding substantially uniform portion with an overall thickness less than said uniform thickness;

wherein each of said plurality of first vanes and said plurality of second vanes respectively having a relatively wide first portion radially proximate to an axis of said anode ring and a relatively narrow second portion extending radially outward from each of said first portion where said respective narrow second portion connects each of said plurality of first and second vanes to said anode ring; and wherein said first portion of each of said plurality of first vanes and said plurality of second vanes is relatively short with respect to an overall length of each of said plurality of first and second vanes yielding a relatively low total capacitance for said vanes.

2. The high impedance circuit of claim 1, wherein each of said first vanes and said second vanes are generally T-shaped.

3. An anode circuit for a magnetron, comprising:

a plurality of first radial vanes, a plurality of second radial vanes interdigitating with said first radial vanes, and an anode ring, said plurality of first and second vanes extending radially inward from said anode ring to provide a vane structure;

at least one strap interconnecting the plurality of either one of said first and second vanes, each of said plurality of first and second vanes respectively having a uniform thickness over a substantial portion thereof with a radially tapered region at an innermost edge of each of said plurality of first and second vanes, each said respective tapered region extending from said corresponding uniform thickness portion with an overall thickness less than said uniform thickness;

wherein each of said plurality of first vanes and said plurality of second vanes respectively having a relatively wide first portion radially proximate to an axis of said anode ring and a relatively narrow second portion extending radially outward from each of said first portion where said respective narrow second portion connects each of said plurality of first and second vanes to said anode ring; and wherein said first portion of each of said plurality of first vanes and said plurality of second vanes is relatively short with respect to overall length of each of said plurality of first and second vanes.

4. The anode circuit of claim 3, wherein said first vanes and said second vanes are each T-shaped.

5. An anode circuit for a magnetron, comprising:

a plurality of T-shaped anode vanes extending radially inward from an anode ring, each of said vanes respectively having a relatively wide portion and a corresponding relatively narrow second portion extending radially outward from said respective wide portion, each of said vanes connecting to said anode ring at an end of said respective narrow portion opposite from said corresponding wide portion;

at least one strap coaxially disposed along a respective side of each one of said plurality of vanes, said strap interconnecting alternating ones of said plurality of vanes; and each of said vanes having a respective tapered region disposed at an end of said wide portion and each of said tapered regions comprising a respective knife edge.

6. An anode circuit for a magnetron, comprising:

a plurality of T-shaped anode vanes extending radially inward from an anode ring, each of said vanes respectively having a relatively wide portion and a corresponding relatively narrow second portion extending radially outward from said respective wide portion, each said narrow portion comprising a majority of a radial extent of the corresponding one of said plurality of vanes, each of said vanes connecting to said anode ring at an end of said respective narrow portion opposite from said corresponding wide portion;

at least one strap coaxially disposed along a respective side of each one of said plurality of vanes, said strap interconnecting alternating ones of said plurality of vanes; and each of said vanes having a respective tapered region disposed at an end of said wide portion and each of said tapered regions comprising a respective rounded edge.

7. An anode circuit for a magnetron, comprising:

a plurality of T-shaped anode vanes extending radially inward from an anode ring, each of said vanes respectively having a relatively wide portion and a corresponding relatively narrow second portion extending radially outward from said respective wide portion, each of said vanes connecting to said anode ring at an end of said respective narrow portion opposite from said corresponding wide portion;

at least one strap coaxially disposed along a respective side of each one of said plurality of vanes, said strap interconnecting alternating ones of said plurality of vanes; and each of said vanes having a respective tapered region disposed at an end of said corresponding wide portion and each of said tapered regions comprising a respective compound taper.

* * * * *